US005388352A

United States Patent [19]

Ralph

[11] Patent Number: 5,388,352

[45] Date of Patent: Feb. 14, 1995

[54] NEEDLEWORK PATTERN DISPLAY AND VISUAL GUIDING DEVICE

[76] Inventor: Lilias Ralph, 6917 Black Pine NE., Albuquerque, N. Mex. 87109

[21] Appl. No.: 115,235

[22] Filed: Sep. 2, 1993

[51] Int. Cl.[6] ..... D06C 3/08

[52] U.S. Cl. ..... 38/102.1

[58] Field of Search ..... 38/102, 102.1, 102.2, 38/102.4, 102.91, 103; 112/78, 103; 33/1 AA, 113, 11, 12, 16, 623, 613

[56] References Cited

U.S. PATENT DOCUMENTS

| | | | |
|---|---|---|---|
| 1,159,901 | 11/1915 | Corrall et al. | 112/103 |
| 2,806,440 | 9/1957 | Schenkengel | 112/103 |
| 2,894,468 | 7/1959 | Nohl | 112/103 |
| 4,762,076 | 8/1988 | Wakaizumi | 38/102.2 X |
| 4,774,778 | 10/1988 | Williams | 38/102.2 |
| 5,027,989 | 7/1991 | Nevius | 38/102.1 |
| 5,144,899 | 9/1992 | Allen | 112/103 |

FOREIGN PATENT DOCUMENTS

| | | | |
|---|---|---|---|
| 2299165 | 9/1973 | France | 33/1 AA |

*Primary Examiner*—Clifford D. Crowder
*Assistant Examiner*—Ismael Izaguirre
*Attorney, Agent, or Firm*—Basile and Hanlon

[57] ABSTRACT

The present invention comprises a needlework pattern display and visual guiding device. The device provides a mechanism for displaying a needlework pattern, and a mechanism for releasably attaching the pattern display mechanism to a needlework stretching apparatus. The device includes a mechanism for visually guiding a user to a desired position on the pattern, and a mechanism for attaching the guiding mechanism to the pattern display mechanism. Patterns affixed upon stretching apparatus can be displayed in varying positions in closest proximity to needleworking, while guiding the eyes, with minimal effort, to specific pattern symbols, thereby markedly reducing eye and neck strain while significantly increasing speed.

8 Claims, 2 Drawing Sheets

NEEDLEWORK PATTERN DISPLAY AND VISUAL GUIDING DEVICE

BACKGROUND OF THE INVENTION

The present invention relates generally to needlepoint devices, and more particularly to such a device which aids in completing a needlepoint pattern quickly, accurately and efficiently.

Needlework art, practiced by millions of persons of all ages, is growing both in direct proportion to the increase of population and the increasing proportion of elderly people. A basic essential of the art's application is a pattern in the form of Cartesian coordinate-arranged small symbols indicating required yarn or "floss" color and location of required needle insertion points. Conventionally, a suitable needlepointing fabric is tautly assembled to a "scroll frame" designed to allow fabric to be progressively exposed for needlepointing. The frame is usually ether mounted to a free-standing holding device or maintained in the lap. The pattern is usually either clipped to the scroll frame holder or the scroll frame itself or placed on a table alongside the person.

Basically, the needlepointing cycle involves "look" and "do". The person looks at the pattern to determine the required floss color and point of insertion of the floss-threaded needle through the frame-mounted fabric. The person then inserts the needle through the fabric and, as required floss changes, cuts and ties the floss on the under surface of the fabric. Conventionally, the look portion of the needlepointing cycle takes between ten and thirty percent of the time, depending mainly on the person's age and physical condition. Moreover, the eye and neck strain attendant to looking and making sure that the pattern is being read properly both reduces the pleasure of the art and limits its application.

Thus it is an object of the present invention to provide a needlepoint and which will reduce to a minimum the effort required to read needlepoint patterns during the needlepointing function, i.e., discern the required floss colors and points of needle insertion through the fabric. It is a further object of the invention to provide such an aid which incorporates a needlepoint pattern display device which easily attaches to conventional fabric-mounting scroll frames of all sizes and which is maneuverable with minimal effort to generally have a minimum required distance between the pattern and the needlepointing position. Still further, it is an object of the present invention to provide such a device which incorporates, upon its pattern display device, a pattern detail visual guiding device, which advantageously minimizes eye and neck strain and hence errors when reading the pattern. Yet still further, it is an object of the present invention to provide such a device which reduces fatigue and cycle time of present needlepoint art, while at the same time increasing its pleasure.

SUMMARY OF THE INVENTION

The present invention addresses and solves the problems enumerated above. The present invention comprises a needlework pattern display and visual guiding device. The device provides means for displaying a needlework pattern, and means for releasably attaching the pattern display means to a needlework stretching apparatus. The device includes means for visually guiding a user to a desired position on the pattern, and means for attaching the guiding means to the pattern display means.

BRIEF DESCRIPTION OF THE DRAWINGS

Other objects and features of the present invention will become apparent by reference to the following detailed description and drawings, in which.

DETAILED DESCRIPTION OF THE PREFERRED EMBODIMENTS

Figure 1:
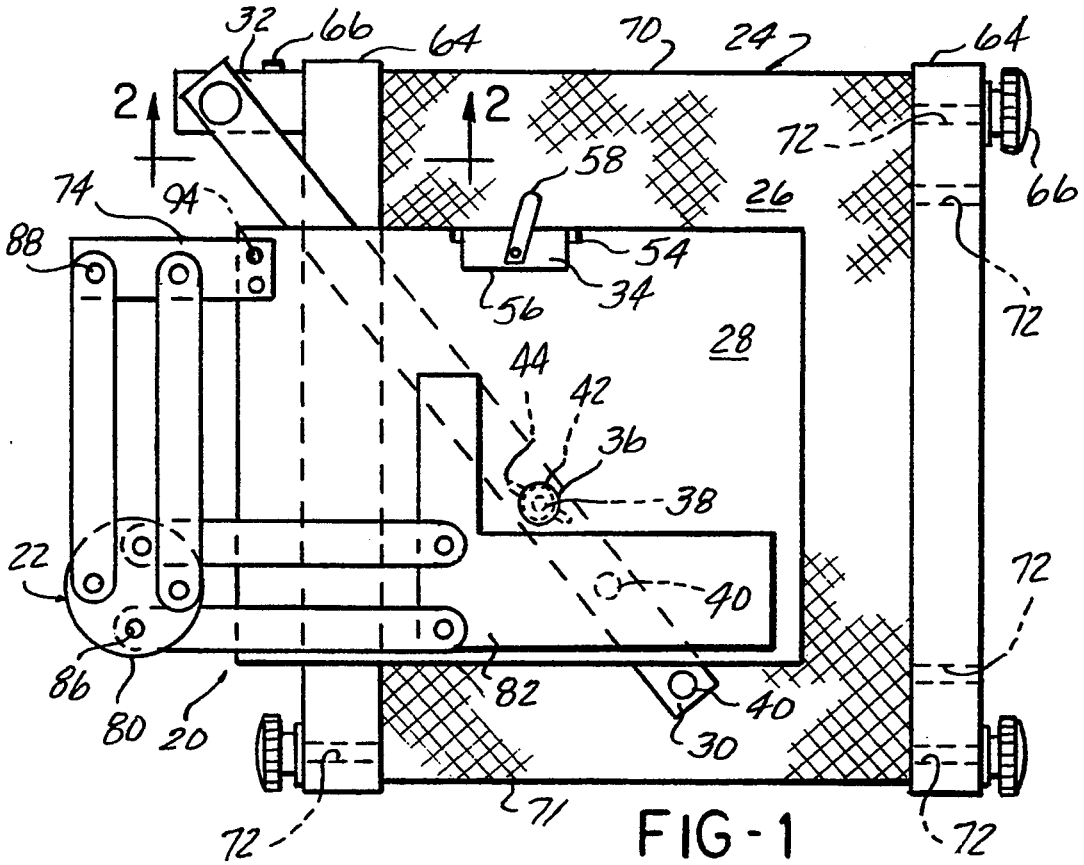
FIG. 1 is a front view of the preferred embodiment of the invention, shown attached to a needlepoint scroll frame.

A first preferred embodiment of the invention is specified in FIGS. 1–4. In FIG. 1, the invention's needlepoint pattern display device, designated generally 20, with its assembled needlepoint pattern detail visual guiding or indicating device, designated generally 22, is shown mounted to a conventional needlepoint scroll frame 24 with needlepoint fabric 26 tautly assembled thereto. Needlepoint pattern 100 (FIG. 4) is affixed upon device 20, beneath the movable mechanism of indicating device 22. The pattern 100 takes the form of small floss color-indicating symbols 102 placed in squares of cross hatched paper, in accordance with Cartesian coordinates. It is to be understood that the present invention is shown for use with a scroll frame as an example; the present invention may be used with, or modified for use with any type of needleworking frame, hoop, etc. or any similar needleworking stretching apparatus.

Pattern display device 20 comprises panel 28, arm 30, mounting bracket 32 and pattern clamp 34. Panel 28 is preferably formed from a suitably rigid material and of a generally flat configuration. However, it is to be understood that any suitable material and configuration may be chosen. Some of the many advantageous aspects of panel 28 are as follows. It holds a pattern 100 in close proximity to the needleworking fabric 26; due to the material and configuration of panel 28, pattern 100 stays securely in place; and, due to the absence of light, the image or needlework of the fabric 26 itself, or the like filtering through the back of pattern 100, it is less likely that the pattern will be misread.

Panel 28 pivotally assembles atop arm 30, also preferably formed from a suitably rigid material and of a generally flat configuration, via carrier bolt 36 fixedly pressed into panel bore 38, freely received by one of a plurality of arm bores 40 and releasably assembled to lock washer 42 and wing nut 44. As detailed in FIG. 2, the illustrated upper end of arm 30 pivotally assembles to mounting bracket 32 via carriage bolt 46 fixedly pressed into arm bore 48, freely received by bore 50 of bracket leg 52 and releasably assembled to lock washer 42 and wing nut 44. Pattern clamp 34 may be fixedly assembled, as for example with rivets 54 or any other suitable means, upon panel 28 near its illustrated upper edge and centrally between its sides (or any other desired location). Clamp 34 is preferably a metal spring-controlled type incorporating a vertically-actuable lip 56 and a finger-operable lever 58. Needlepoint pattern 100 is insertable beneath pattern detail indicating device 22 and hence upon panel 28 of pattern display device 20, and is secured by clamp 34 as clamp lever 58 is depressed to raise lip 56, after which the upper edge of the pattern is slid under lip 56 and lever 58 is released. In FIG. 1, it can be noted that panel 28 can, by virtue of the multiple bores 40 of arm 30, be selectively mounted to the arm in different positions, as warranted for different sizes of scroll frames 24.

Figure 2:
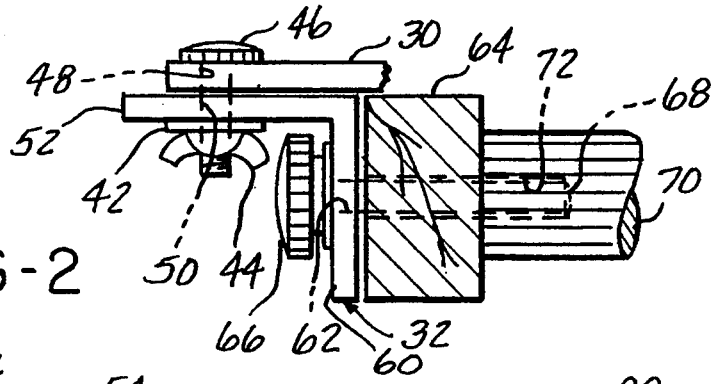
FIG. 2 is a detailed cut away side view of the scroll frame connection means of the invention taken at line 2—2 of FIG. 1.

Referring now to FIG. 2, mounting bracket 32 is shown in its assembled mode. Bracket 32 is preferably made of steel or any other suitably rigid material and is right angle formed and punched to produce the illustrated horizontal leg 52 with mounting bore 50 and vertical leg 60 with mounting bore 62. Arm 30 pivotally (horizontally) assembles to horizontal leg 52 as described above, while the bracket's vertical leg 60 pivotally (vertically) assembles to the outer surface of side rail 64 of scroll frame 24 via knob 66 which threadably assembles, with lock washer 42, to stud 68 press fitted in the end of upper roller bar 70 of scroll frame 24, along a stud axis in axial alignment with the bar. Stud 68 is freely received by bore 72 through side rail 64. It is to be noted that each of the side rails 64 may incorporate a plurality of bores 72, some of which are shown in FIG. 1. Also, each end of upper 70 and lower 71 roller bar has an appropriate stud 68 and corresponding knob 66. Thus, depending on sizes and locations of needlepoint detail, roller bar 70 and hence the invention's mounting bracket 32 may be selectively assembled to scroll frame side rails 64 at a plurality of different positions, as desired.

As thus designed, it can be noted that pattern display device 20 can be, by virtue of the connection of its panel 28 to its arm 30 and the arm's connection to mounting bracket 32, both rotated horizontally and pivoted, as required to bring the pattern closest to the fabric location being needlepointed. Also, because of the pivotal feature of bracket 32, display device 20 can be pivoted vertically, as might facilitate inspection of work already needlepointed.

Figure 3:
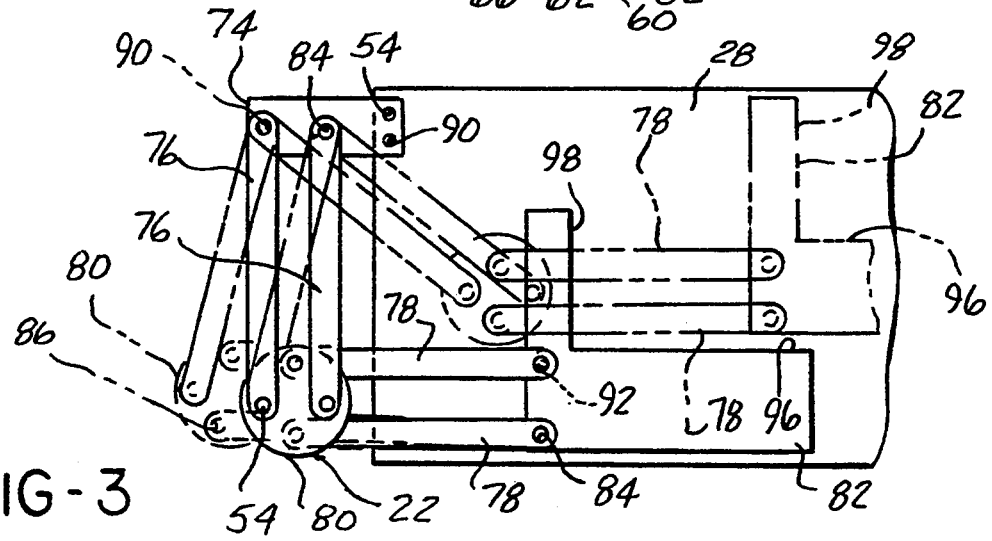
FIG. 3 is a front view of the needlepoint pattern detail visual guiding device of the invention's preferred embodiment, with two alternate visual guiding device positions shown in phantom.

Returning to FIG. 1, it can be observed that the invention's pattern detail indicating device 22 fixedly assembles upon panel 28 and display device 20. As specified above, and described in detail later, needlepoint patterns are insertable between devices 22 and 20. As shown in FIG. 3, device 22 comprises a mounting bracket 74, a first pair of straight and identical, parallel opposed arms 76, a second pair of parallel opposed arms 78, a round-formed arm mounting hub 80 and a right angle-shaped detail indicator 82. Parts 74, 76, 78 and 80 are preferably made of a generally flat metal, or any other suitably rigid material, while part 82 is preferably made of a generally flat polymeric material, or any other suitable material, as desired.

Arms 76 and 78 each incorporate an assembly bore 84 at each end. Hub 80 incorporates four essentially evenly spaced and circumferentially arranged arm assembly bores 86. Arms 76 assemble at one end upon hub 80 at the illustrated 3 and 9 o'clock positions by rivets 54 freely received by arm bores 84 and hub bores 86, and at the other ends upon the upper left-hand surface of bracket 74 by large head rivets 88 freely received by arm bores 84 and bracket bores 90. Similarly, arms 78 assemble at one end to the under surface of hub 80 at the 12 and 6 o'clock positions by rivets 54 freely received by arm bores 84 and hub bores 86, and at the other ends upon the illustrated left-hand surface of detail indicator 82 with rivets 54 freely received by arm bores 84 and indicator bores 92. It is preferable that the spacing should be substantially the same between the arm assembly bores 90 of bracket 74, arm assembly bores 92 of indicator 82, hub bores 86 accommodating arms 76 and hub bores 86 accommodating arms 78. The right-hand end of bracket 74 fixedly assembles, as with rivets 54, upon the upper left-hand corner surface of panel 28 of pattern display device 20, the rivets being received by bracket bores 90 and panel bores 94. Bracket 74 extends leftwardly from panel 28 to allow arms 76 to be connected thereto at a location which optimizes the excursions of detail indicator 82 relative to locations of required needlepointing, as shown on patterns affixed to panel 28 of pattern display device 20. It is to be understood that this is a preferred means of mounting pattern indicating device 22 and detail indicator 82; however, any suitable means may be used.

As shown in phantom in FIG. 3, it is to be noted that, by virtue of the operating principle of the device's pantograph mechanism, the alignment edges 96 and 98 of indicator 82 remain aligned with the x and y axes of panel 28 at all positions which may be taken by the indicator. Three different positions are shown in FIG. 3; however, it is to be understood that any number of positions are possible.

Figure 4:
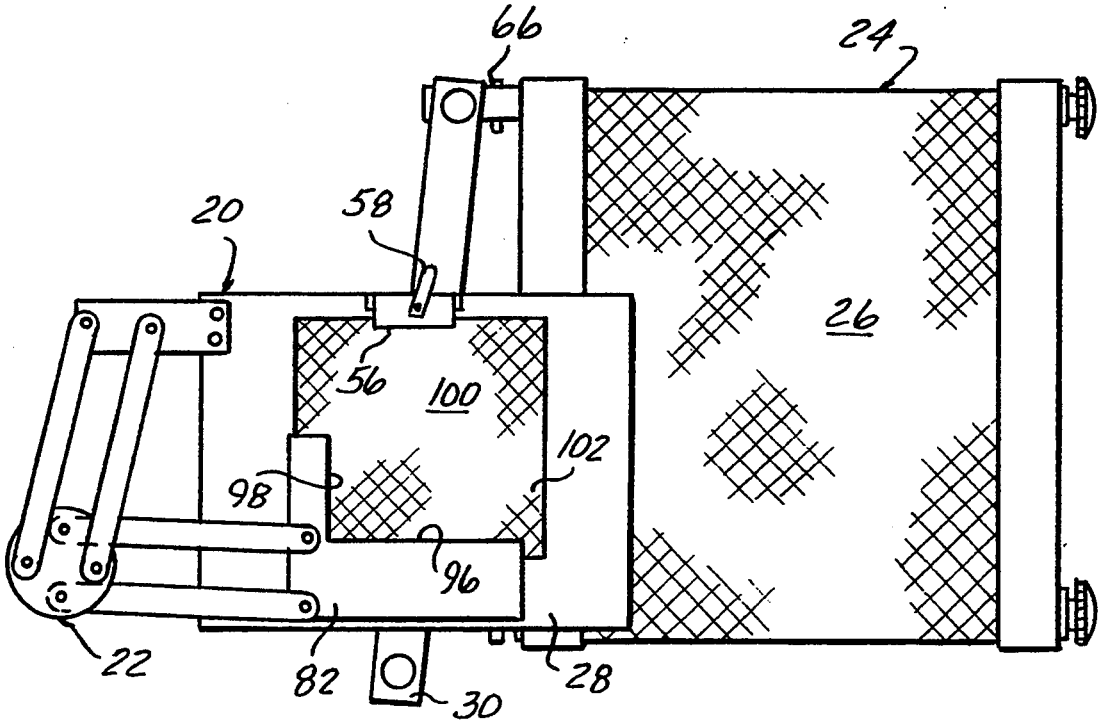
FIG. 4 is a front view of the preferred embodiment of the invention, showing the invention in use.
Figure 5:
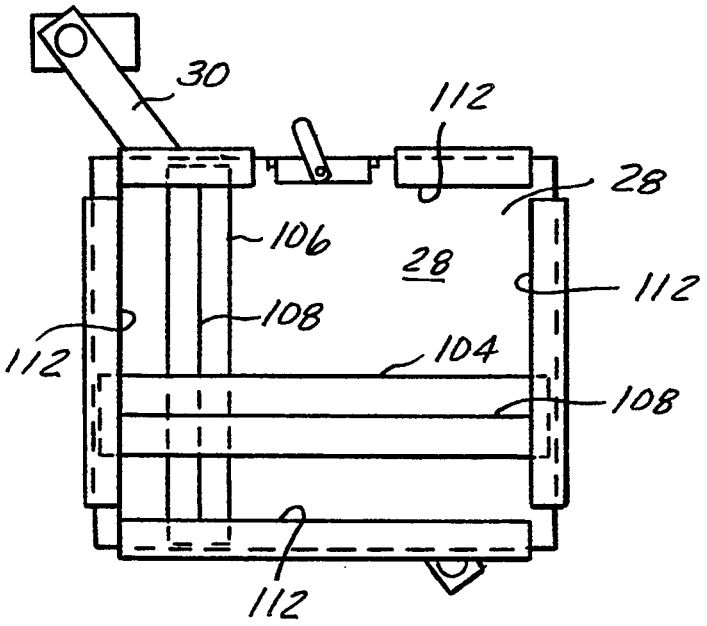
FIG. 5 is a front view of an alternate embodiment of the present invention.

A second preferred embodiment of the invention, shown in FIG. 5, differs from the first in that it provides an alternate means for identification of alignment of symbols 102 of needlepoint pattern 100 (FIG. 4). Otherwise, both embodiments are of the same design and attach to scroll frame 24 in the same manner described above. For a symbol alignment means, the second embodiment incorporates a horizontal cursor 104 and a vertical cursor 106 employed to align with applicable needlepoint pattern symbols 102 in the x and y axes, respectively. Cursors 104 and 106 are made of clear, thin, narrow and rigid plastic strips, or any other suitable material, having lengths corresponding, respectively, to the width and height of needlepoint pattern display panel 28. Both cursors may incorporate a longitudinally-centered thin black line 108 conventionally called a "hairline".

Cursors 104 and 106 are slidably maintained atop panel 28 by "v" cross-sectioned, thin, spring-conditioned clips made preferably of plastic. However, it is to be understood that metal or any other suitable material may be used. The clips slidably assemble over the edges of panel 28, with their converging lips 112 bearing snugly against the panel under the upper surfaces and hence against the ends of cursors 104 and 106 inserted thereunder. Cursor 104 may overlap cursor 106, or vice versa.

Referring now to FIGS. 2 and 4, the preferred embodiment of the invention is shown in the operable mode. A needlepoint scroll frame 24 has a needlepoint fabric 26 tautly assembled thereto. In order to use the present invention, the frame's upper left-hand roller bar knob 66 is disassembled from the bar's stud 68. Vertical leg 60 of the invention's mounting bracket 32 is then assembled to stud 68 via its mounting bore 62 being received by the stud. Knob 66 is then screwed tightly back on stud 68 to thereby secure both bracket 32 and the scroll frame's upper roller bar 70.

A chosen needlepoint pattern 100, conventionally shown on a sheet of thick, white paper, is inserted beneath the movable mechanism of needlepoint pattern detail indicating device 22 and upon panel 28 of needlepoint pattern display device 20. Lever 58 of display device clamp 34 is then depressed to raise clamp lip 56, after which the upper edge of pattern 100 is inserted thereunder and lever 58 is released. Since the pattern is displayed in the form of small, square-contained floss color and needlepoint position-specifying symbols 102 arranged in the x and y axes, the pattern may need to be positionally adjusted to align its axes with respective edges 96 and 98 of detail indicator 82 of pattern detail indicating device 22.

The needlepoint pattern panel 28 is pivoted, via its arm 30, to a location very close to the point of fabric 26 where needlepointing is to begin, tilting the panel upwardly if necessary. Detail indicator 82 is then pivoted to align its edges 96 and 98 beneath and beside, respectively, the chosen needlepoint beginning symbol 102 of pattern 100. The indicator may be retained in this position until one finishes accommodating all symbols thus aligned, whether working horizontally or vertically. Alternately, one may progressively advance indicator 82 from symbol to symbol while retaining edge 96 in the x axis or edge 98 in the y axis, depending on whether one works horizontally or vertically, respectively. To maintain panel 28 and hence pattern 100 as close as possible to the point of fabric 26 requiring needlepointing, panel 28 and hence pattern 100 may, by virtue of arm 30, be progressively pivoted over completed needlepoint as the needlepointing progresses.

Now referring to FIG. 5, an alternate embodiment of the present invention is shown. In the operating mode, the invention is first assembled, as described above, to the chosen scroll frame 24 with the needlepoint fabric assembled thereto. For brevity, the scroll frame, with its fabric, are not shown. The chosen needlepoint pattern 100 is then assembled atop panel 28 in the manner described above. Cursors 104 and 106 are then placed over pattern 100 and assembled horizontally and vertically, respectively, with their ends pressed under top lips 112 of clips 110. The cursors are then positionally adjusted to bring cursor 104 just beneath the chosen first needlepointing symbol 102 and cursor 106 immediately alongside this symbol. Panel 28 is then pivoted, by virtue of its arm 30, to a location very close to the point of fabric 26 where the needlepointing is to begin, tilting the panel upwardly if necessary. Depending on whether the needlepointing is to proceed horizontally or vertically, one cursor is maintained stationary until all symbols 102 of its positioned line or row are accommodated, while the other cursor is progressively, slidably symbol-indexed in accordance with progress of needlepointing. To maintain panel 28 and hence pattern 100 as close as possible to the point of fabric 26 (FIG. 4) requiring needlepointing, panel 28 may be progressively pivoted over completed needlepoint as the needlepointing progresses.

As thus designed, it can be appreciated that the present invention allows for marked reduction of eye and neck strain attendant to continuous looking of relatively excessive distances from the needlepointing work to the pattern symbols, and vice-versa. Among other features and advantages of the present invention, the reduction of eye and neck strain substantially reduces fatigue while increasing speed and pleasure of needlepoint art.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A needlework pattern display and visual guiding device, comprising:

means for displaying a needlework pattern, wherein the pattern display means comprises:

a panel having a generally flat configuration and sized to display a desired portion of the pattern; and means, attached to the panel for retaining the pattern on the panel;

means for releasably attaching the pattern display means to a needlework stretching apparatus;

pointing means for guiding a user's eyes to a desired position on the pattern, wherein the guiding means comprises:

a horizontal cursor bar; and a vertical cursor bar;

wherein the cursor bars are slidably attached to, and flush against the panel and wherein the cursor bars can selectively be placed at any desired location on the pattern; and means for attaching the guiding means to the pattern display means.

2. The needlework pattern display and visual guiding device as defined in claim 1 wherein the means for attaching the guiding means to the pattern display means comprises:

spring-biased clips formed from a polymeric material, the clips slidably received over horizontal and vertical edges of the panel; and converging lips disposed at panel contacting edges of the clips, the lips bearing snugly against the panel and against the adjacent ends of the horizontal and vertical cursor bars slidably received thereunder.

3. A needlework pattern display and visual guiding device, comprising:

means for displaying a needlework pattern, wherein the pattern display means comprises:

a panel having a generally flat configuration and sized to display a desired portion of the pattern; and means, attached to the panel, for retaining the pattern on the panel;

means for releasably attaching the pattern display means to a needlework stretching apparatus, wherein the releasable pattern display attaching means comprises:

an L-shaped bracket having two legs with each of the legs having a bore therethrough;

means for attaching the bracket to the needlework stretching apparatus, wherein the means for attaching the bracket to the stretching apparatus comprises:

a threaded stud extending outwardly along an axis from the stretching apparatus and adapted to freely extend through the bore in one of the bracket legs; and a tightening knob threadingly and releasably engageable with the stud and adapted to secure the one bracket leg, wherein the bracket is selectively pivotable about the stud axis; and means for attaching the bracket to the panel, wherein the means for attaching the bracket to the panel comprises an arm pivotally linked at a first end via the other bracket leg bore, the arm first end being selectively pivotable about a first pivot axis perpendicular to the stud axis, the arm further being pivotally linked at a second end to the panel, the arm second end being selectively pivotable about a second pivot axis parallel to the first pivot axis;

pointing means for guiding a user's eyes to a desired position on the pattern; and means for attaching the guiding means to the pattern display means.

4. The needlework pattern display and visual guiding device as defined in claim 3, wherein the retaining means comprises:

a spring controlled clamp having a panel contacting edge surface;

a vertically actuable lip defined on the panel contacting edge surface; and a manually operable lever which, upon actuation, raises the lip off the panel to allow the pattern to be removed from, or placed on the panel.

5. The needlework pattern display and visual guiding device as defined in claim 3, wherein the guiding means comprises an indicator bar configured to be flush against the panel and slidably attached to the panel, wherein the indicator bar is selectively placed against any desired location on the pattern.

6. The needlework pattern display and visual guiding device a defined in claim 5 wherein the indicator bar is a right angle bar, and wherein the means for attaching the guiding means to the pattern display means comprises:

an indicator mounting bracket fixedly attached to a corner of the panel;

a first pair of parallel opposed arms pivotally mounted at one end to the indicator mounting bracket;

a round-formed arm mounting hub operatively and rotationally connected to the other end of the first pair of opposed arms; and a second pair of parallel opposed arms, operatively and rotationally connected at one end to the mounting hub, and pivotally mounted at the other end to the right angle indicator bar.

7. A needlework pattern display and visual guiding device, comprising:

means for displaying a needlework pattern, wherein the pattern display means comprises:

a panel having a generally flat configuration and sized to display a desired portion of the pattern; and means, attached to the panel, for retaining the pattern on the panel, wherein the retaining means comprises:

a spring controlled clamp having a panel contacting edge surface;

a vertically actuable lip defined on the panel contacting edge surface; and a manually operable lever which, upon actuation, raises the lip off the panel to allow the pattern to be removed from, or placed on the panel;

means for releasably attaching the pattern display means to a needlework stretching apparatus, wherein the releasable pattern display attaching means comprises:

an L-shaped bracket having two legs with each of the legs having a bore therethrough;

means for attaching the bracket to the needlework stretching apparatus, wherein the means for attaching the bracket to the stretching apparatus comprises:

a threaded stud extending outwardly along an axis from the stretching apparatus and adapted to freely extend through the bore in one of the bracket legs; and a tightening knob threadingly and releasably engageable with the stud and adapted to secure the one bracket leg, wherein the bracket is selectively pivotable about the stud axis; and means for attaching the bracket to the panel, wherein the means for attaching the bracket to the panel comprises an arm pivotally linked at a first end via the other bracket leg bore, the arm first end being selectively pivotable about a first pivot axis perpendicular to the stud axis, the arm further being pivotally linked at a second end to the panel, the arm second end being selectively pivotable about a second pivot axis parallel to the first pivot axis;

pointing means for guiding a user's eyes to a desired position on the pattern, wherein the guiding means comprises:

an indicator bar configured to be flush against the panel and slidably attached to the panel, wherein the indicator bar is selectively placed against any desired location on the pattern; and means for attaching the guiding means to the pattern display means, wherein the means for attaching the guiding means to the pattern display means comprises:

an indicator mounting bracket fixedly attached to a corner of the panel;

a first pair of parallel opposed arms pivotally mounted at one end to the indicator mounting bracket;

a round-formed arm mounting hub operatively and rotationally connected to the other end of the first pair of opposed arms; and a second pair of parallel opposed arms, operatively and rotationally connected at one end to the mounting hub, and pivotally mounted at the other end to the right angle indicator bar.

8. A needlepoint pattern display and visual guiding device, comprising:

means for displaying a needlework pattern, wherein the pattern display means comprises:

a panel having a generally flat configuration and sized to display a desired portion of the pattern; and means, attached to the panel, for retaining the pattern on the panel, wherein the retaining means comprises:

a spring controlled clamp having a panel contacting edge surface;

a vertically actuable lip defined on the panel contacting edge surface; and a manually operable lever which, upon actuation, raises the lip off the panel to allow the pattern to be removed from, or placed on the panel;

means for releasably attaching the pattern display means to a needlepoint scroll frame, wherein the releasable pattern display attaching means comprises:

an L-shaped bracket having two legs with each of the legs having a bore therethrough;

means for attaching the bracket to the needlepoint scroll frame, wherein the means for attaching the bracket to the stretching apparatus comprises:

a threaded stud extending outwardly along an axis from the stretching apparatus and adapted to freely extend through the bore in one of the bracket legs; and a tightening knob threadingly and releasably engageable with the stud and adapted to secure the one bracket leg, wherein the bracket is selectively pivotable about the stud axis; and means for attaching the bracket to the panel, wherein the means for attaching the bracket to the panel comprises an arm pivotally linked at a first end via the other bracket leg bore, the arm first end being selectively pivotable about a first pivot axis perpendicular to the stud axis, the arm further being pivotally linked at a second end to the panel, the arm second end being selectively pivotable about a second pivot axis parallel to the first pivot axis;

pointing means for guiding a user's eyes to a desired position on the pattern, wherein the guiding means comprises:

an indicator bar configured to be flush against the panel and slidably attached to the panel, wherein [it may]the indicator bar is selectively placed against any desired location on the pattern; and means for attaching the guiding means to the pattern display means, wherein the means for attaching the guiding means to the pattern display means comprises:

an indicator mounting bracket fixedly attached to a corner of the panel;

a first pair of parallel opposed arms pivotally mounted at one end to the indicator mounting bracket;

a round-formed arm mounting hub operatively and rotationally connected to the other end of the first pair of opposed arms; and a second pair of parallel opposed arms, operatively and rotationally connected at one end to the mounting hub, and pivotally mounted at the other end to the right angle indicator bar.

* * * * *